US009896864B2

(12) United States Patent
Zhu et al.

(10) Patent No.: US 9,896,864 B2
(45) Date of Patent: Feb. 20, 2018

(54) DIRECT-INSERTION BALUSTER CONNECTING DEVICE

(71) Applicant: Suzhou Uni-Solution Import and Export Company Ltd., Suzhou (CN)

(72) Inventors: Jianzhong Zhu, Suzhou (CN); Jianmin Gu, Suzhou (CN)

(73) Assignee: Suzhou Uni-Solutions Import and Export Company Ltd., Suzhou (CN)

( * ) Notice: Subject to any disclaimer, the term of this patent is extended or adjusted under 35 U.S.C. 154(b) by 0 days.

(21) Appl. No.: 15/064,737

(22) Filed: Mar. 9, 2016

(65) Prior Publication Data

US 2017/0089094 A1 Mar. 30, 2017

(30) Foreign Application Priority Data

Sep. 25, 2015 (CN) ..... 2015 1 0618598

(51) Int. Cl.
*E04H 17/14* (2006.01)
*E04H 17/22* (2006.01)
*E04F 11/18* (2006.01)

(52) U.S. Cl.
CPC ..... *E04H 17/1443* (2013.01); *E04H 17/1421* (2013.01); *E04H 17/22* (2013.01); *E04F 11/1844* (2013.01); *E04F 2011/1819* (2013.01); *E04F 2011/1823* (2013.01); *E04F 2011/1827* (2013.01); *E04H 2017/1452* (2013.01)

(58) Field of Classification Search
CPC ..... E04F 2011/1819; E04F 2011/1821; E04H 17/1421; E04H 17/1443; E04H 2017/1452; E04H 17/1434; E04H 2017/1447; E04H 2017/1469; Y10T 403/4637; Y10T 403/7047
USPC ..... 256/65.04, 65.05, 65.06, 65.14, 65.07; 403/243, 365
See application file for complete search history.

(56) References Cited

U.S. PATENT DOCUMENTS 626,733 A * 6/1899 Stewart ..... E04H 17/14 256/65.06
7,125,002 B2 * 10/2006 Platt ..... E04H 17/1421 256/65.02
8,783,662 B1 * 7/2014 Russo ..... E04H 17/1417 256/65.03
9,228,372 B2 * 1/2016 Bertato ..... E04H 17/1421
2004/0206028 A1 * 10/2004 Terrels ..... E04H 17/1443 52/287.1

(Continued)

FOREIGN PATENT DOCUMENTS

GB 2342705 A * 4/2000 ..... E04H 17/1413

*Primary Examiner* — Josh Skroupa
*Assistant Examiner* — Cory B Siegert
(74) *Attorney, Agent, or Firm* — Muncy, Geissler, Olds & Lowe, P.C.

(57) ABSTRACT

A direct-insertion baluster connecting device, including a fence frame and a plurality of balusters uniformly arranged within the fence frame. The fence frame is a square frame jointly consisting of two vertical posts, an upper rail and a lower rail. The fence frame and the balusters are hollow tubes and a plurality of rivet nuts are arranged about the lower end of each vertical post. The disclosed direct-insertion baluster connecting device can be used for the installed fence frame formed by the vertical posts, upper rail and lower rail, and then it only needs to directly insert the balusters and make connection in a specified manner.

7 Claims, 10 Drawing Sheets

(56) References Cited

U.S. PATENT DOCUMENTS

| | | | | |
|---|---|---|---|---|
| 2006/0175594 | A1* | 8/2006 | Burkart | E04F 11/1817 256/65.02 |
| 2008/0272353 | A1* | 11/2008 | Fattori | E04F 11/1812 256/19 |
| 2009/0026431 | A1* | 1/2009 | Tremblay | E04H 17/1443 256/65.03 |
| 2015/0115214 | A1* | 4/2015 | Schneider | E04F 11/1834 256/67 |

* cited by examiner

DIRECT-INSERTION BALUSTER CONNECTING DEVICE

CROSS-REFERENCES TO RELATED APPLICATIONS

This application claims priority to Chinese Patent Application No. CN201510618598.5, filed on Sep. 25, 2015, the entire content of which is incorporated herein by reference.

FIELD OF THE INVENTION

The present invention relates to a baluster connecting device, and particularly relates to a direct-insertion baluster connecting device, belonging to the field of fences.

BACKGROUND OF THE INVENTION

In existing fence systems, common baluster installing methods are relatively complex and cumbersome. Some requires to weld on site a baluster to an upper rail and a lower rail, however appearance treatment are needed after welding. Some involves fabricating a plurality of balusters into a whole piece, and then splicing the same on site, but the whole rail structure is large in volume and unadjustable in the splicing size. These bring great trouble to on-site installation and need great human and material resources.

SUMMARY OF THE INVENTION

In order to solve the above-mentioned technical problems, the present invention sets forth a direct-insertion baluster connecting device which is convenient for disassembly and assembly, safe and beautiful.

To achieve the above object, the present invention adopts a technical solution as follows: a direct-insertion baluster connecting device includes a fence frame and a plurality of balusters uniformly arranged within the fence frame; the fence frame is a square frame jointly formed by two vertical posts, an upper rail and a lower rail; the fence frame and the balusters are all hollow tubes; and a plurality of rivet nuts are arranged about the lower end of each vertical post.

Preferably, a plurality of preformed holes for installing the balusters are provided uniformly and symmetrically in the upper rail and the lower rail respectively.

Preferably, an upper plastic sleeve and a lower plastic sleeve are embedded at the two ends of each baluster respectively, the upper plastic sleeve being installed in the preformed hole of the upper rail, the lower plastic sleeve being installed in the preformed hole of the lower rail, and the length of the upper plastic sleeve being larger than that of the lower plastic sleeve.

Preferably, the two ends of the lower rail are installed between the lower ends of the two vertical posts respectively by connectors.

Preferably, the connector, as a rectangular frame, is provided with a boss in a middle position therein, and provided with opening support bars at both sides of the lower part thereof respectively; the lower rail is a hollow rectangular tube, and the two ends of the lower rail are inserted into inner frames of the connectors, and sleeved on the bosses; the width between edges of the two opening support bars is larger than that of the lower rail; to install the lower rail, the lower rail is directly inserted into the inner frames of the connectors and sleeved on the bosses, thus achieving preliminary positioning of the lower rail to prevent deviation of the installed lower rail.

Preferably, shims are provided at both ends of the lower rail respectively, and the shims are U-shaped pieces, sleeved on the lower part of the lower rail; the width of the shims is larger than that between the edges of the two opening support bars; after positioned, the lower rail is lifted up, and the shims slide into the inner frames of the connectors and rest on the opening support bars, thus well positioning the lower rail in the connectors, the opening support bars playing a supporting role, and the lower rail being propped up by the U-shaped pieces and placed within the connectors, which is very convenient.

Preferably, the upper rail is a composite section, which may include flexible extrusion layer and aluminum substrate, or decorative thin metal layer and aluminum substrate, for the purpose of bringing in more comfort of grasping after the upper rail is externally provided with a clad layer of various materials, and the clad layer on the vertical posts may also be subjected to various decorative surface treatment so that the upper rail appears more elegant and beautiful.

Preferably, the connector is also provided with a plurality of screw holes, and the assembled lower rail is fixed by anti-detachment screws. The lower rail being fixed by the anti-detachment screws after positioned and assembled prevents stealthy disassembly of the fence, being very safe. Moreover, the lower rail is directly inserted into the connectors with no need to weld or expose the lower rail, thus appearing very beautiful.

Preferably, the vertical posts are hollow rectangular tubes, and connectors are arranged on four faces of the lower ends of the vertical posts respectively. The rivet nuts are arranged in different directions of the vertical posts. Connectors of one or more directions can be installed according to requirement of connection of the vertical posts. Of course, the vertical posts may also be cylindrical tubes.

The present invention has the beneficial effect that the direct-insertion baluster connecting device adopted in the present invention can be used for the installed fence frame formed by the vertical posts, upper rail and lower rail, and then it only needs to directly insert the balusters and make connection in a specified manner. The whole connecting process is a welding-free process, and only needs manual assembly in a DIY manner, thus ensuring beauty and safety, as well as convenient and labor-saving assembly, and it can be accomplished without too much auxiliary work.

Figure 1:
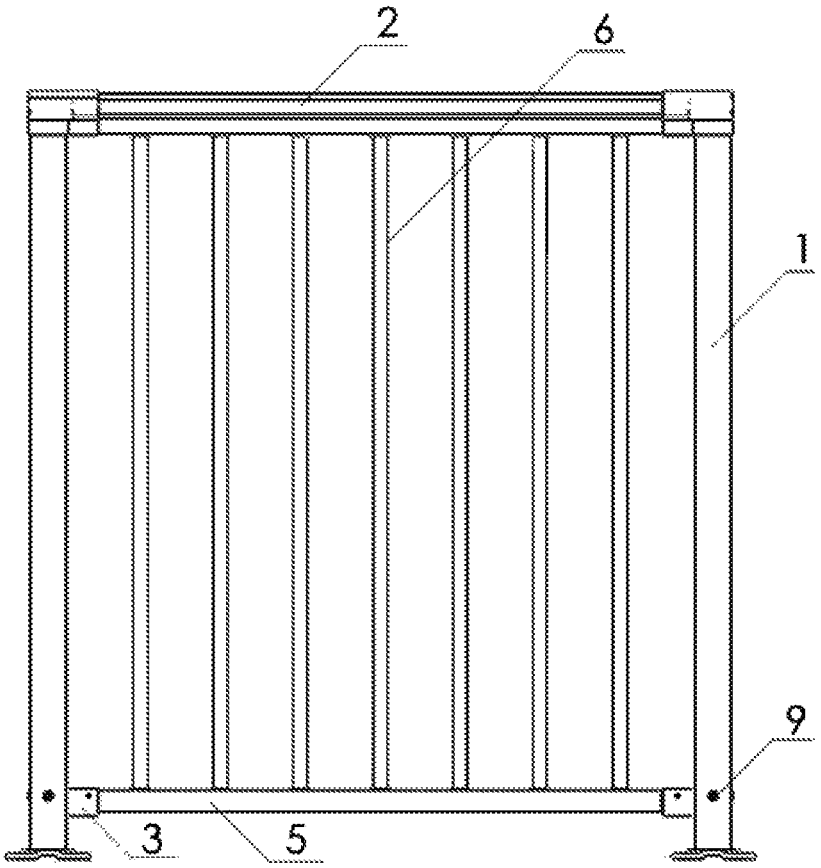
FIG. 1 illustrates a structure diagram of an exemplary direct-insertion baluster connecting device consistent with various disclosed embodiments.

Reference numerals: 1. vertical post, 2. upper rail, 3. connector, 4. shim, 5. lower rail, 6. baluster, 7. upper plastic sleeve, 8. lower plastic sleeve, 9. connector, rivet nut, 10. preformed hole, 11. screw hole, 2A. boss, 2B. opening support bar.

DETAILED DESCRIPTION OF THE EMBODIMENTS

The present invention is further described below in detail in conjunction with specific implementations.

Figure 2:
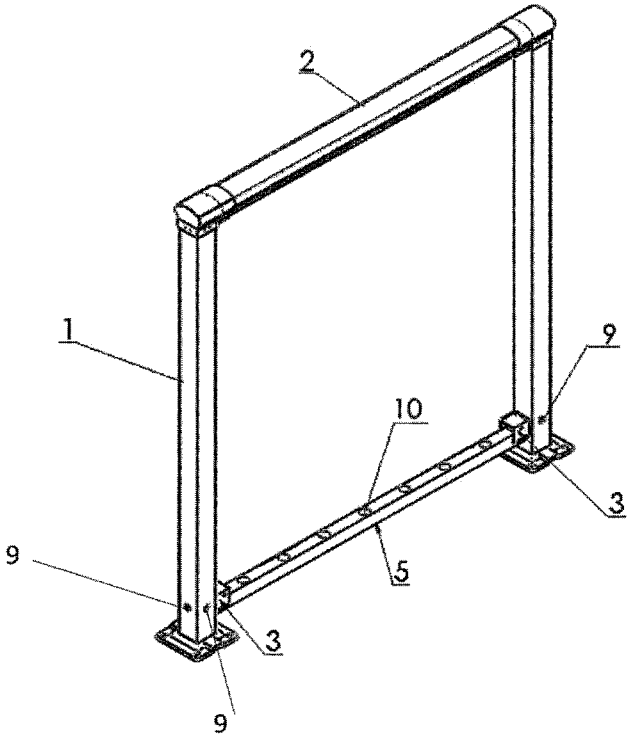
FIG. 2 illustrates a structure diagram of a fence frame consistent with various disclosed embodiments.
Figure 3:
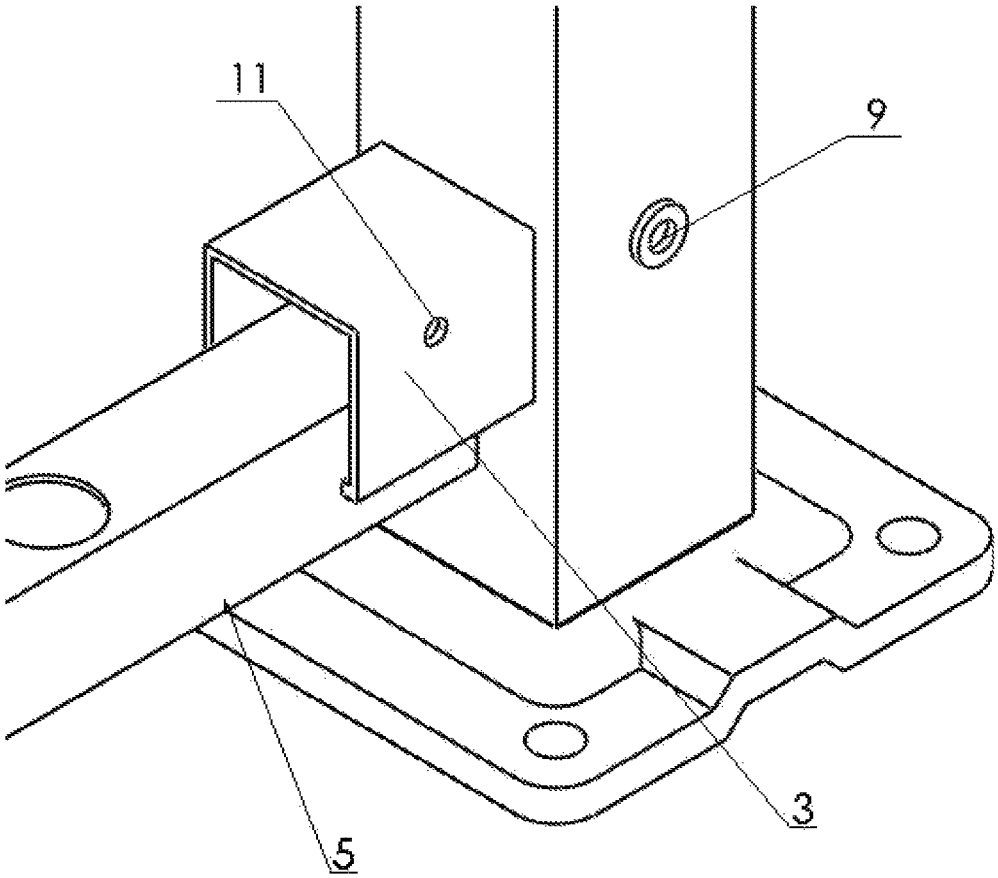
FIG. 3 illustrates an installation diagram of a lower rail consistent with various disclosed embodiments.
Figure 4:
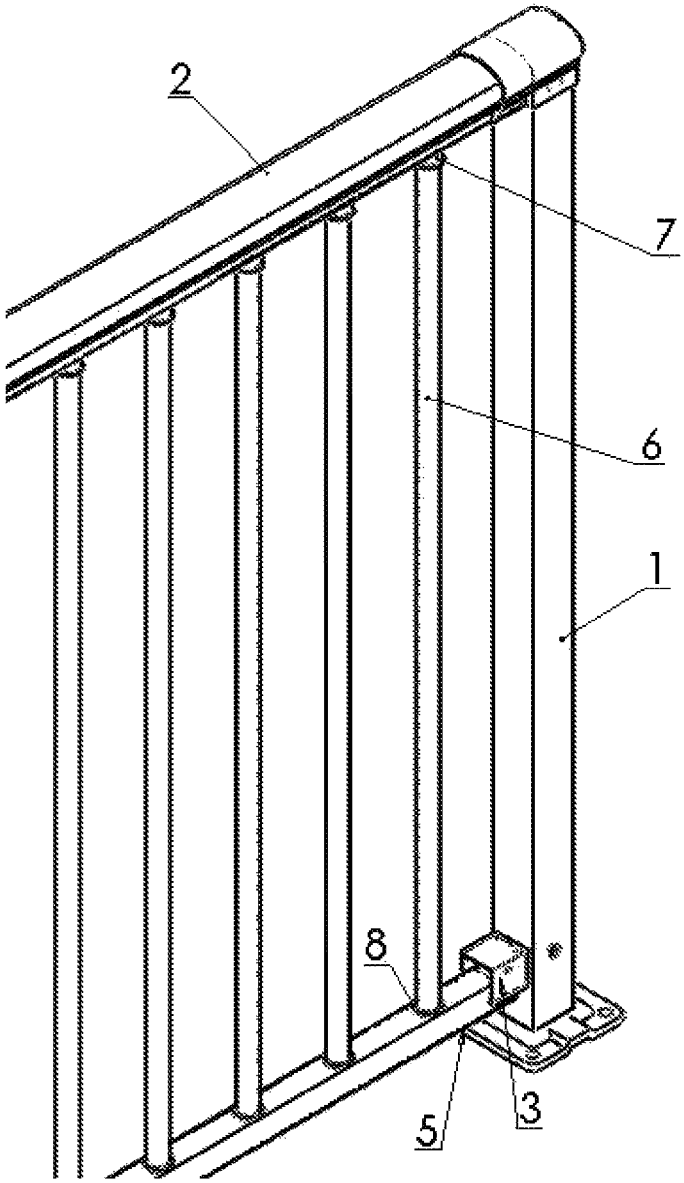
FIG. 4 illustrates a partial structure diagram of a baluster consistent with various disclosed embodiments.
Figure 5:
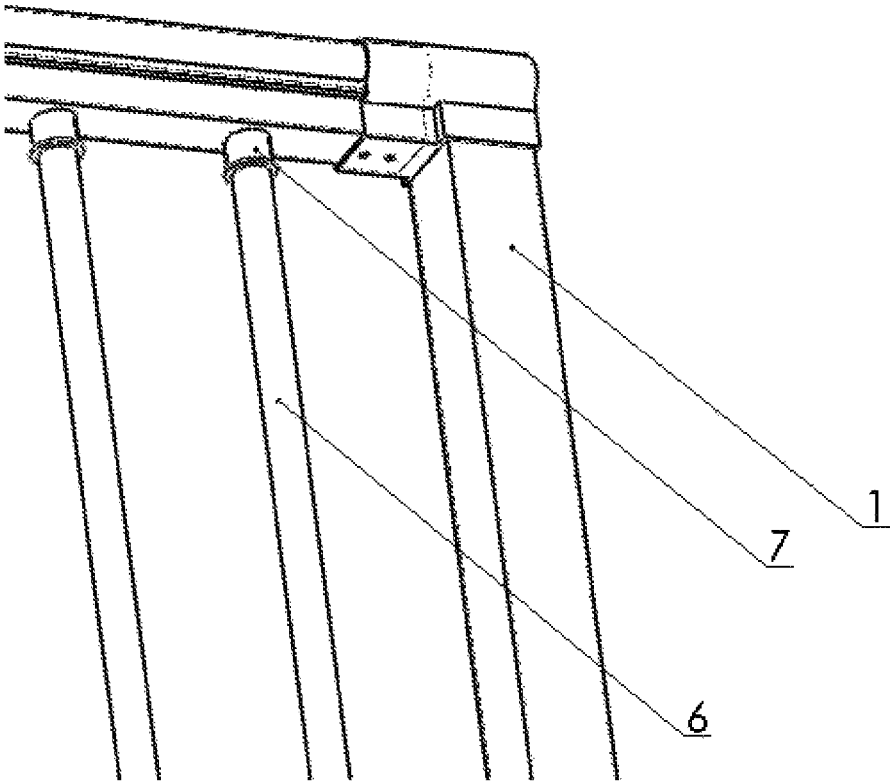
FIG. 5 illustrates a partial enlarged view of A in FIG. 4 consistent with various disclosed embodiments.
Figure 6:
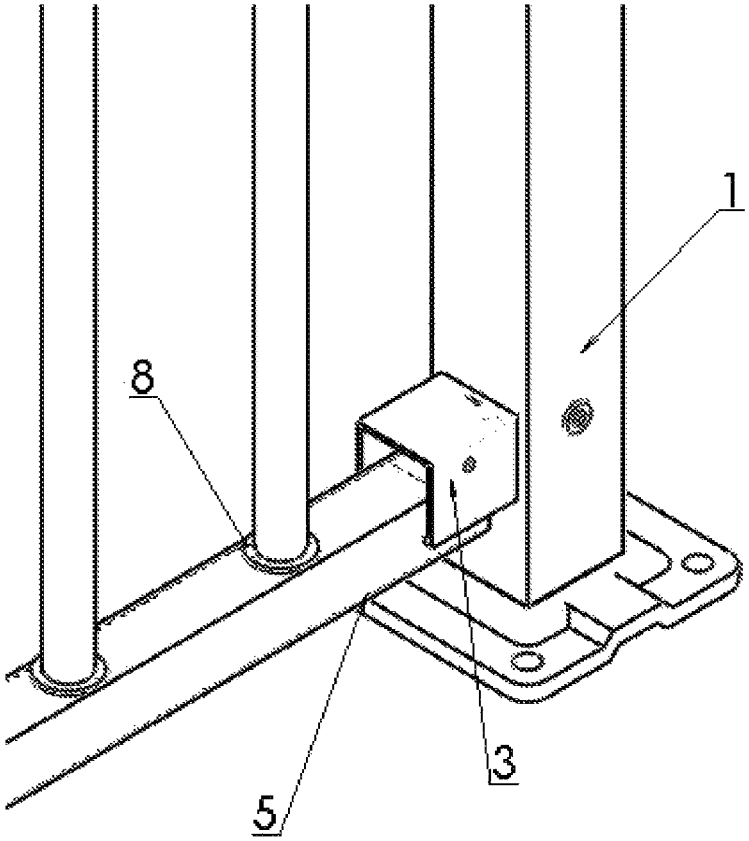
FIG. 6 illustrates a partial enlarged view of B in FIG. 4 consistent with various disclosed embodiments.
Figure 7:
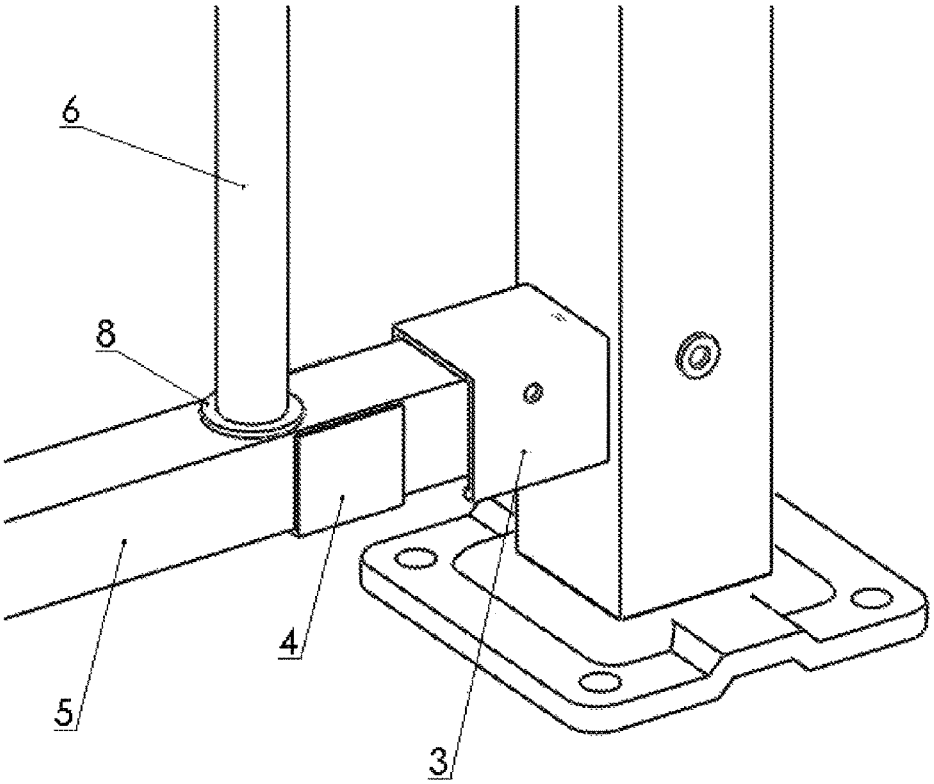
FIG. 7 illustrates a structure diagram before a shim is inserted into a connector inner frame consistent with various disclosed embodiments.
Figure 8:
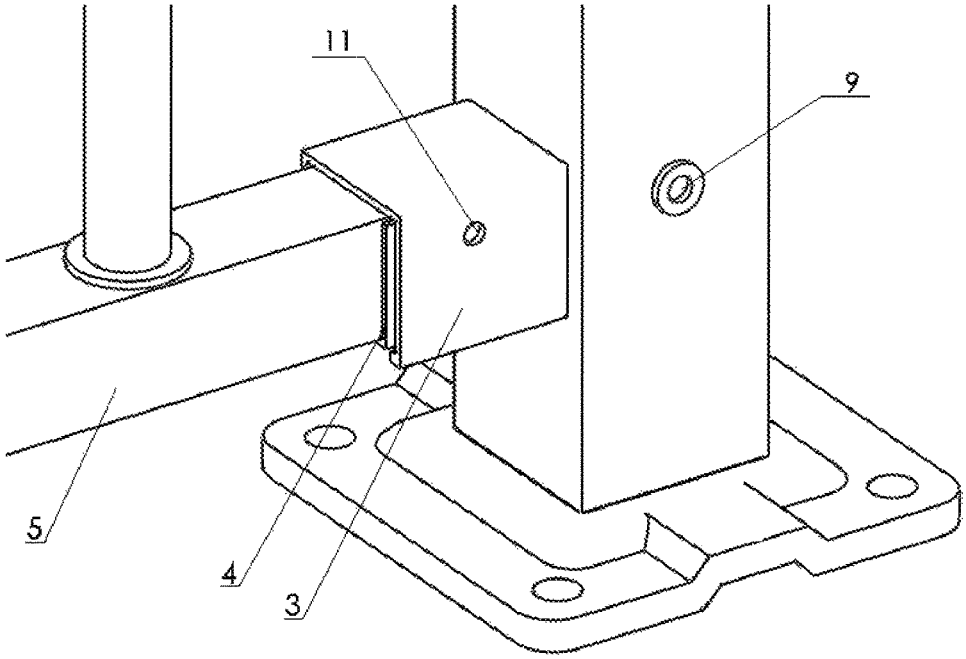
FIG. 8 illustrates a structure diagram after a shim is inserted into a connector inner frame consistent with various disclosed embodiments.
Figure 9:
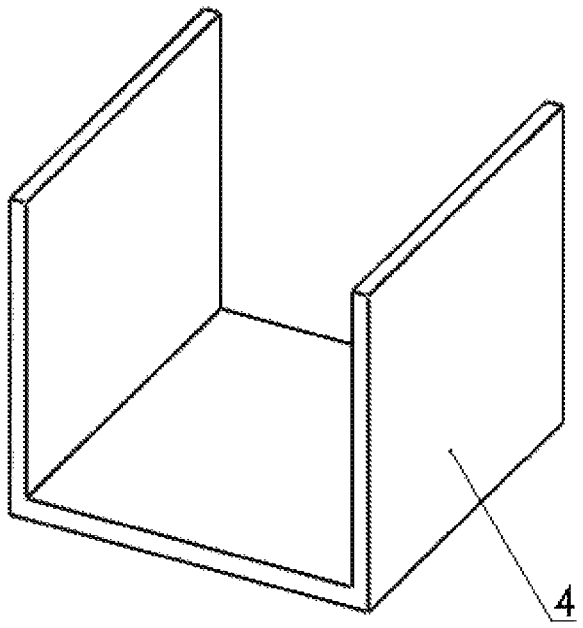
FIG. 9 illustrates a structure diagram of a shim consistent with various disclosed embodiments.
Figure 10:
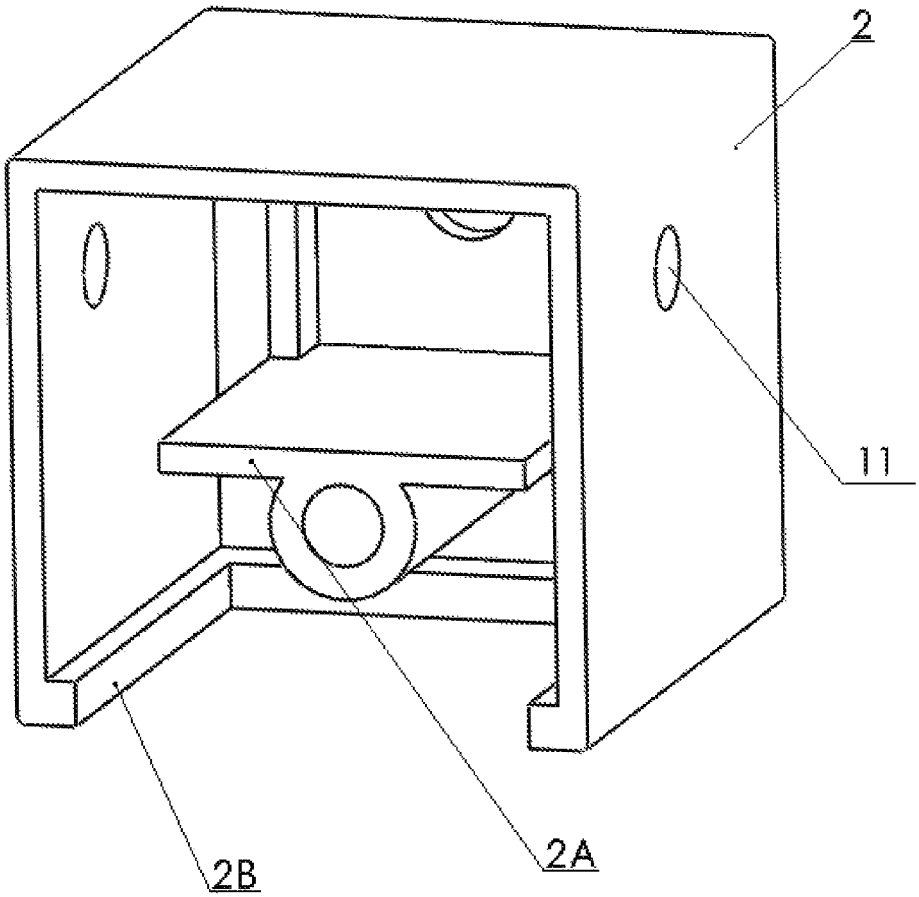
FIG. 10 illustrates a structure diagram of a connector consistent with various disclosed embodiments.
Figure 11:
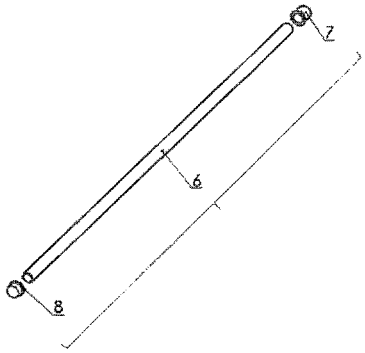
FIG. 11 illustrates an installation diagram of a baluster and upper and lower plastic sleeves consistent with various disclosed embodiments.
Figure 12:
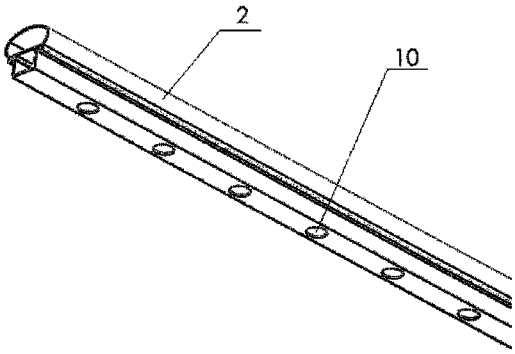
FIG. 12 illustrates a partial structure diagram of an upper rail consistent with various disclosed embodiments.

As shown in FIGS. 1-12, a direct-insertion baluster connecting device includes a fence frame and a plurality of balusters 6 uniformly arranged within the fence frame; the fence frame is a square frame jointly consisting of two vertical posts 1, an upper rail 2 and a lower rail 5; the fence frame and the balusters 6 are all hollow tubes; and a plurality of connectors 3 are arranged about the lower end of each vertical post 1.

A plurality of preformed holes 10 for installing the balusters 6 are provided uniformly and symmetrically in the upper rail 2 and the lower rail 5 respectively.

An upper plastic sleeve 7 and a lower plastic sleeve 8 are embedded at the two ends of each baluster 6 respectively, the upper plastic sleeve 7 being installed in the preformed hole 10 of the upper rail 2, the lower plastic sleeve 8 being installed in the preformed hole 10 of the lower rail 5, and the length of the upper plastic sleeve 7 being larger than that of the lower plastic sleeve 8.

The two ends of the lower rail 5 are installed between the lower ends of the two vertical posts 1 respectively by connectors 3.

The connector 3, as a rectangular frame, is provided with a boss 2A in a middle position therein, and provided with opening support bars 2B at both sides of the lower part thereof respectively; the lower rail 5 is a hollow rectangular tube, and the two ends of the lower rail 5 are inserted into inner frames of the connectors 3, and sleeved on the bosses 2A; the width between edges of the two opening support bars 2B is larger than that of the lower rail; to install the lower rail 5, the lower rail 5 is directly inserted into the inner frames of the connectors 3 and sleeved on the bosses 2A, thus achieving preliminary positioning of the lower rail 5 to prevent deviation of the installed lower rail 5.

Shims 4 are provided at both ends of the lower rail 5 respectively, and the shims 4 are U-shaped pieces, sleeved on the lower part of the lower rail 5; the width of the shims 4 is larger than that between the edges of the two opening support bars 2B; after positioned, the lower rail 5 is lifted up, and the shims 4 slide into the inner frames of the connectors 3 and rest on the opening support bars 2B, thus well positioning the lower rail 5 in the connectors 3, the opening support bars 2B playing a supporting role, and the lower rail 5 being propped up by the U-shaped pieces and placed within the connectors 3, which is very convenient.

The upper rail 2 is a composite section, which may include flexible extrusion layer and aluminum substrate, or decorative thin metal layer and aluminum substrate, for the purpose of bringing in more comfort of grasping after the upper rail is externally provided with a clad layer of various materials. The clad layer on the vertical posts may also be subjected to various decorative surface treatment so that the upper rail appears more elegant and beautiful.

The connector 3 is further provided with two screw holes 11, and the assembled lower rail 5 is fixed by anti-detachment screws. The lower rail 5 being fixed by the anti-detachment screws after positioned and assembled prevents stealthy disassembly of the fence, being very safe. Moreover, the lower rail 5 is directly inserted into the connectors 3 with no need to weld or expose the lower rail 5, thus appearing very beautiful.

The vertical posts 1 are hollow rectangular tubes, and rivet nuts 9 are arranged on four faces of the lower ends of the vertical posts 1 respectively. The rivet nuts 9 are arranged in different directions of the vertical posts 1. Connectors 3 of one or more directions can be installed according to requirement of connection of the vertical posts 1. Of course, the vertical posts 1 may also be cylindrical tubes.

The assembly process is as follows:

(1) the vertical posts 1, the upper rail 2 and the lower rail 5 are assembled according to tube interfaces to form a square frame, and the balusters 6 are inserted into the preformed holes 10 of the upper rail 2 and the lower rail 5;

(2) to install the lower rail 5, first the connectors 3 are installed at the lower ends of the two vertical posts 1, and then the two ends of the lower rail 5 are inserted into the connectors 3;

(3) in inserting the lower rail 5 into the inner frames of the connectors 3, the lower rail 5 is sleeved on the bosses 2A, thus achieving preliminary positioning;

(4) after the lower rail 5 is positioned, the lower rail 5 is lifted up, the shims 4 are sleeved at the lower parts of the two ends of the lower rail 5, the shims 4 slide into the inner frames of the connectors 3 and rest on the opening support bars 2B, thus accomplishing assembly of the whole lower rail 5; and (5) after assembly and positioning of the lower rail 5, the lower rail 5 is fixed by anti-detachment screws, thus accomplishing assembly of the whole rail fence.

What is claimed is:

1. A direct-insertion baluster connecting device, comprising:

a fence frame;

a plurality of balusters uniformly arranged within the fence frame;

the fence frame being a square frame jointly formed by two vertical posts, an upper rail and a lower rail;

the fence frame and the balusters being hollow tubes;

a plurality of rivet nuts are arranged about a lower end of each vertical post; and two ends of the lower rail being installed between the lower ends of the two vertical posts respectively by connectors;

wherein each connector has an opening support bar located at both sides of a lower part of the connector respectively and parallel to the lower rail; and a boss is provided in a middle position in the connector;

wherein the two ends of the lower rail are inserted into rectangular frames of the connectors;

wherein a width between edges of the two opening support bars is larger than a width of the lower rail; and wherein shims are provided at the two ends of the lower rail respectively, and the shims are U-shaped pieces sleeved on the lower part of the lower rail between the lower rail and the connectors, a width of the shims is larger than the width between the edges of the two opening support bars.

2. The direct-insertion baluster connecting device according to claim 1, wherein a plurality of preformed holes for installing the balusters are provided uniformly and symmetrically in the upper rail and the lower rail respectively.

3. A direct-insertion baluster connecting device, comprising:

a fence frame;

a plurality of balusters uniformly arranged within the fence frame;

the fence frame being a square frame jointly formed by two vertical posts, an upper rail and a lower rail;

the fence frame and the balusters being hollow tubes;

a plurality of rivet nuts are arranged about a lower end of each vertical post; and two ends of the lower rail being installed between the lower ends of the two vertical posts respectively by connectors;

wherein each connector has an opening support bar located at both sides of a lower part of the connector respectively and parallel to the lower rail;

a boss is provided in a middle position in the connector;

wherein a plurality of preformed holes for installing the balusters are provided uniformly and symmetrically in the upper rail and the lower rail respectively; and wherein an upper plastic sleeve and a lower plastic sleeve are embedded at two ends of each baluster respectively, the upper plastic sleeve is installed in the preformed hole of the upper rail, the lower plastic sleeve is installed in the preformed hole of the lower rail, and a length of the upper plastic sleeve is larger than that of the lower plastic sleeve.

4. The direct-insertion baluster connecting device according to claim 1, wherein the lower rail is a hollow rectangular tube, sleeved on the bosses.

5. The direct-insertion baluster connecting device according to claim 1, wherein the upper rail is a composite section.

6. The direct-insertion baluster connecting device according to claim 1, wherein the connector is further provided with a plurality of screw holes, and the assembled lower rail is fixed by anti-detachment screws.

7. The direct-insertion baluster connecting device according to claim 1, wherein the vertical posts are hollow rectangular tubes, and the plurality of rivet nuts are arranged on four faces of the lower ends of each vertical post.

* * * * *